US011608541B2

(12) United States Patent
Zhang et al.

(10) Patent No.: US 11,608,541 B2
(45) Date of Patent: Mar. 21, 2023

(54) MANUFACTURING METHOD FOR HIGH SILICON GRAIN ORIENTED ELECTRICAL STEEL SHEET

(71) Applicant: BAOSHAN IRON & STEEL CO., LTD., Shanghai (CN)

(72) Inventors: Huabing Zhang, Shanghai (CN); Shuangjie Chu, Shanghai (CN); Guobao Li, Shanghai (CN); Wen Xiao, Shanghai (CN); Baojun Liu, Shanghai (CN); Yongjie Yang, Shanghai (CN); Kanyi Shen, Shanghai (CN); Dan Han, Shanghai (CN); Zhining Hu, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 150 days.

(21) Appl. No.: 17/040,684

(22) PCT Filed: Mar. 25, 2019

(86) PCT No.: PCT/CN2019/079442
§ 371 (c)(1),
(2) Date: Sep. 23, 2020

(87) PCT Pub. No.: WO2019/184838
PCT Pub. Date: Oct. 3, 2019

(65) Prior Publication Data

US 2021/0047706 A1 Feb. 18, 2021

(30) Foreign Application Priority Data

Mar. 29, 2018 (CN) ..... 201810272499.X

(51) Int. Cl.
*C21D 9/46* (2006.01)
*C21D 6/00* (2006.01)
(Continued)

(52) U.S. Cl.
CPC ..... *C21D 9/46* (2013.01); *C21D 6/008* (2013.01); *C21D 8/1222* (2013.01);
(Continued)

(58) Field of Classification Search
CPC ..... C21D 9/46; C21D 6/008; C21D 8/1222; C21D 8/1233; C21D 8/1255;
(Continued)

(56) References Cited

U.S. PATENT DOCUMENTS

2014/0342094 A1* 11/2014 Hofener ..... C23C 24/04 427/446

FOREIGN PATENT DOCUMENTS

CN 1692164 11/2005
CN 1692164 A * 11/2005 ..... C21D 8/1277
(Continued)

OTHER PUBLICATIONS

International Search Report and Written Opinion dated Jun. 6, 2019 for PCT Patent Application No. PCT/CN2019/079442.

*Primary Examiner* — Anthony M Liang
*Assistant Examiner* — Danny N Kang
(74) *Attorney, Agent, or Firm* — Lei Fang, Esq.; Smith Tempel Blaha LLC

(57) ABSTRACT

Disclosed is a manufacturing method for a high silicon grain oriented electrical steel sheet, the silicon content of the high silicon grain oriented electrical steel is greater than 4 wt %, comprising the steps of: (1) performing decarburization annealing of a cold-rolled steel plate; (2) allowing high silicon alloy particles in a completely solid state to collide at a high speed with the surface of the decarburization annealed steel plate to be sprayed, thus forming a high silicon alloy coating on the surface of the steel plate to be sprayed; (3) coating a release agent and drying; and (4) annealing. The manufacturing method for the high silicon
(Continued)

grain oriented electrical steel sheet of the present invention is inexpensive, and, the high silicon grain oriented electrical steel sheet produced is of stable quality and is provided with great magnetic performance.

14 Claims, 1 Drawing Sheet

(51) Int. Cl.

| | |
|---|---|
| ***C22C 38/00*** | (2006.01) |
| ***C21D 8/12*** | (2006.01) |
| ***C22C 38/02*** | (2006.01) |
| ***C22C 38/04*** | (2006.01) |
| ***C22C 38/06*** | (2006.01) |

(52) U.S. Cl.
CPC ..... *C21D 8/1233* (2013.01); *C21D 8/1255* (2013.01); *C21D 8/1272* (2013.01); *C21D 8/1283* (2013.01); *C22C 38/001* (2013.01); *C22C 38/002* (2013.01); *C22C 38/02* (2013.01); *C22C 38/04* (2013.01); *C22C 38/06* (2013.01); *C21D 2201/05* (2013.01); *C22C 2202/02* (2013.01)

(58) Field of Classification Search
CPC ..... C21D 8/1272; C21D 8/1283; C21D 2201/05; C21D 1/76; C21D 8/1205; C21D 8/1261; C21D 8/1277; C21D 8/1288; C21D 8/12; C22C 38/001; C22C 38/002; C22C 38/02; C22C 38/04; C22C 38/06; C22C 2202/02; C23C 10/46; C23C 10/30; C23C 24/04
See application file for complete search history.

(56) References Cited

FOREIGN PATENT DOCUMENTS

| | | | | |
|---|---|---|---|---|
| CN | 1692165 | | 11/2005 | |
| CN | 107338432 | | 11/2017 | |
| CN | 107338432 A | * | 11/2017 | ..... C23C 24/04 |
| JP | H0643607 | | 6/1994 | |

* cited by examiner

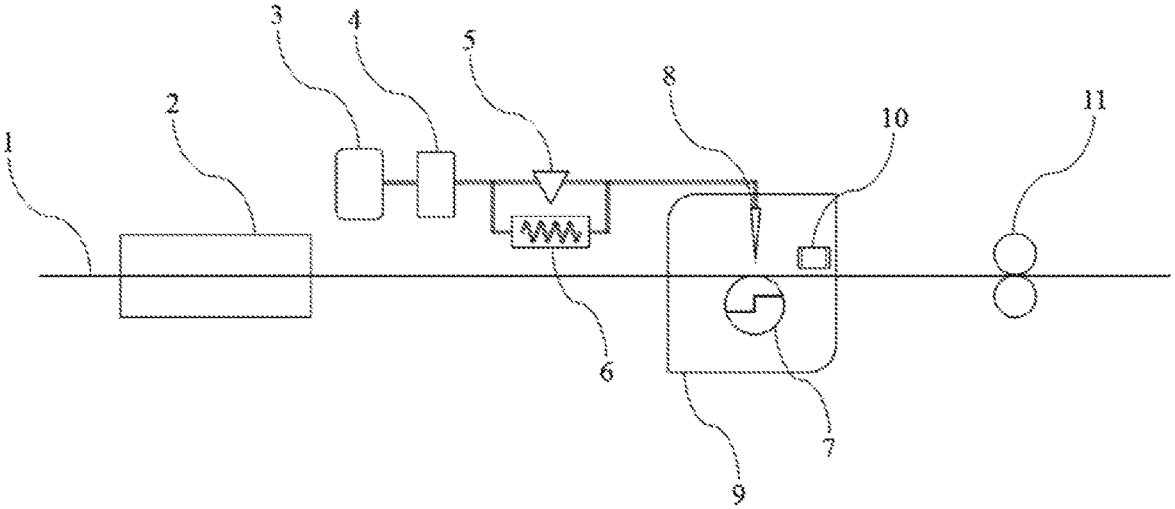
1
2
3
4
5
6
7
8
9
10
11

MANUFACTURING METHOD FOR HIGH SILICON GRAIN ORIENTED ELECTRICAL STEEL SHEET

CROSS-REFERENCE TO RELATED APPLICATIONS

This application is a 371 U.S. National Phase of PCT International Application No. PCT/CN2019/079442 filed on Mar. 25, 2019, which claims benefit and priority to Chinese patent application no. 201810272499.X filed on Mar. 29, 2018, which is incorporated by reference herein in its entirety.

TECHNICAL FIELD

The invention relates to a method for manufacturing an electrical steel plate, and particularly to a method for manufacturing a grain-oriented electrical steel plate.

BACKGROUND OF INVENTION

Electrical steel plates are generally divided into grain-oriented electrical steel plates and non-oriented electrical steel plates. Among them, the grain-oriented electrical steel plate has a silicon content of about 3 wt % and a crystal texture with a grain orientation of (110)[001]. It has excellent magnetic performance along the rolling direction and can be used as core materials of transformers, engines, generators and other electronic equipment.

In recent years, operating frequency of some electronic and electrical components are increased for improving the efficiency, sensitivity and size reduction, and thus the demand for iron core materials having excellent high-frequency magnetic properties are gradually increased. The high silicon steel plate containing 6.5 wt % of Si has a magnetostriction coefficient (λs) of approximate zero, thus has a significantly reduced iron loss under high frequency, a high maximum magnetic permeability (μm), and a low magnetic induction coercive force (Hc), which is most suitable for manufacturing motors and audios with high-speed and high-frequency, high-frequency transformers, choke coils, and magnetic shields at high frequencies, and can also be used for reducing engine energy consumption and improve engine efficiency.

However, high silicon steel plate cannot be produced by conventional processes as hot rolling, cold rolling and annealing of the prior art. In the prior art, Chinese patent publication CN107217129A, dated Sep. 29, 2017, titled as "High silicon steel plate with excellent processability and magnetic properties and production method thereof", discloses a method for manufacturing a high silicon steel plate, wherein vertical double-rollers are used to directly cast high silicon strips having a thickness of 5 mm or less and Si content of 4%-7%, Al content of 0.5%-3%, and mixture of Si and Al content of 4.5%-8%, followed by hot rolling, cold rolling and annealing processes to obtain the final product. Chinese patent publication CN1692164A dated Nov. 2, 2005, titled as "A method for manufacturing a high silicon grain-oriented electrical steel plate with an excellent iron loss performance", discloses a high silicon grain-oriented electrical steel plate, wherein, based on conventional method for manufacturing oriented-silicon steel, the surface of the decarburization annealed steel plate is coated with a slurry silicified powder coating agent, and then the silicon diffusion reaction is activated during the high-temperature annealing at 1200° C. to obtain the high silicon steel plate. Although the products manufactured by the methods above have excellent magnetic properties, a mass production by the method is difficult due to facts such as high manufacturing costs and unstable product quality, thus the method is difficult for commercialization.

Based on this, it is expected to obtain a method for manufacturing a high silicon grain-oriented electrical steel plate that is of low cost, and the manufactured high silicon grain-oriented electrical steel plate has stable quality and excellent magnetic properties.

SUMMARY OF INVENTION

The purpose of the invention is to provide a method for manufacturing a high silicon grain-oriented electrical steel plate that is of low cost, and the manufactured high silicon grain-oriented electrical steel plate has stable quality and excellent magnetic properties.

To achieve the above purpose, the invention provides a method for manufacturing a high silicon grain-oriented electrical steel plate, wherein the high silicon grain-oriented electrical steel plate has a silicon content of greater than 4 wt %, the method comprising steps of:

(1) performing a decarburization annealing with cold-rolled steel plate;

(2) having high silicon alloy particles of complete solid state collide with the surface of the decarburization annealed steel plate to be sprayed at high speed, so as to form a high silicon alloy coating on the surface of the steel plate to be sprayed;

(3) coating a separation agent and drying;

(4) annealing.

In step (2) of the above method, that is, during the cold spray process, the high silicon alloy particles do not melt before colliding with the surface of the steel plate to be sprayed at high speed. The high silicon alloy particles undergo strong plastic deformation in the micro-region of the surface of the steel plate to be sprayed during the collision, and their kinetic energy is converted into thermal energy and strain energy, thus depositing on the surface of the steel plate to be sprayed to form a high-silicon alloy coating. In step (3), in some embodiments, the separation agent may be mainly composed of MgO, $Al_2O_3$ or a mixture of both. Since in the method of the present invention, it is not necessary to form magnesium silicate base layer ($Mg_2SiO_4$) as in the conventional process for manufacturing the grain-oriented electrical steel plate, the separation agent with lower activity than conventional such as MgO can be used.

Further, the method for manufacturing a high silicon grain-oriented electrical steel plate according to the present invention, wherein in step (2), the high silicon alloy particles have a Si content of 10-50 wt %.

In the method of the present invention, the inventor of the invention finds through research that when the high silicon alloy particles have a Si content less than 10 wt %, in order to produce the high silicon grain-oriented electrical steel plate of the present invention, it is necessary to increase the thickness of the high silicon alloy coating and prolong the subsequent silicon diffusion period during high-temperature annealing, resulting in a decrease in production efficiency. When the high silicon alloy particles have a Si content more than 50 wt %, the plastic deformation ability of the high silicon alloy particles is weakened, making it more difficult for forming the silicon alloy coating. Therefore, the inventor of the invention limits the element Si content in the high silicon alloy particles to 10-50 wt %.

Further, the method for manufacturing a high silicon grain-oriented electrical steel plate according to the present invention, wherein in step (2), the high silicon alloy particles have a particle size of 1-80 μm.

In the method of the present invention, the inventor of the invention finds through research that if the high silicon alloy particles have a particle size less than 1 μm, the manufacturing cost of the high silicon alloy particles will increase, and the surface of the high silicon alloy particles will be easily oxidized. When the high silicon alloy particles have a particle size greater than 80 μm, it is difficult for the high silicon alloy particles to be accelerated to the critical speed for bonding during the spraying process. Therefore, the inventor of the invention limits the particle size of the high silicon alloy particles to 1-80 μm.

Further, the method for manufacturing a high silicon grain-oriented electrical steel plate according to the present invention, wherein in step (2), the high silicon alloy particles of complete solid state collide with the surface of the decarburization annealed steel plate to be sprayed at a speed of 500-900 m/s.

In the method of the present invention, the inventor of the invention finds through research that when the collision speed of high silicon alloy particles is lower than 500 m/s, only erosion occurs without bonding, and when the collision speed of high silicon alloy particles is higher than 900 m/s, the high silicon alloy particles will corrode the high silicon grain-oriented electrical steel plate. Therefore, the inventor of the invention controls the collision speed of the high-silicon alloy particles at 500-900 m/s.

Further, the method for manufacturing a high silicon grain-oriented electrical steel plate according to the present invention, wherein in step (2), the high silicon alloy particles are driven by jet flow of working gas to collide with the surface of the decarburization annealed steel plate to be sprayed.

Further, the method for manufacturing a high silicon grain-oriented electrical steel plate according to the present invention, wherein in step (2), the working gas is nitrogen, helium or mixture of nitrogen and helium.

Further, the method for manufacturing a high silicon grain-oriented electrical steel plate according to the present invention, wherein in step (2), the high silicon alloy particles and working gas are ejected via a nozzle onto the surface of the steel plate to be sprayed so that the high silicon alloy particles of complete solid state collide with the surface of the decarburization annealed steel plate to be sprayed at high speed.

Further, the method for manufacturing a high silicon grain-oriented electrical steel plate according to the present invention, wherein in step (2), the temperature of the high silicon alloy particles at the outlet of the nozzle is controlled as 80-500° C.

In the method of the present invention, the inventor of the invention finds through research that when the temperature of the high silicon alloy particles at the outlet of the nozzle is lower than 80° C., the effect of increasing the adhesion cannot be achieved due to low temperature, and when the temperature of the high silicon alloy particles is higher than 500° C., the high silicon alloy particles are easily oxidized, which in turn leads to an increase in surface defects of the final high silicon steel plate. Therefore, the inventor of the invention limits the temperature of the high silicon alloy particles at the outlet of the nozzle within the range of 80-500° C.

Further, the method for manufacturing a high silicon grain-oriented electrical steel plate according to the present invention, wherein in step (2), the working gas is heated to 200-700° C. and then is sent to the nozzle.

In the above technical solution, heating the gas can increase the speed of the high silicon alloy particles, and also make the high silicon alloy particles have a certain temperature, so that the high silicon alloy particles are more prone to plastic deformation when they collide with the steel plate to be sprayed.

Further, the method for manufacturing a high silicon grain-oriented electrical steel plate according to the present invention, wherein in step (2), the nozzle is Laval nozzle.

Further, the method for manufacturing a high silicon grain-oriented electrical steel plate according to the present invention, wherein in step (2), the outlet of the nozzle is set 10-60 mm away from the surface of the steel plate to be sprayed.

In the method of the present invention, in order to prevent the deceleration and excessive oxidation of the high silicon alloy particles in the working gas, the distance between the outlet of the nozzle and the surface of the steel plate to be sprayed is limited to 10-60 mm.

Further, the method for manufacturing a high silicon grain-oriented electrical steel plate according to the present invention, wherein in step (2), the high silicon alloy coating is formed on surface of one side or both sides of the steel plate to be sprayed, and the thickness of the high silicon alloy coating satisfies the following formula:

$$T_c/T_s \geq (x1-x2)/(x3-x1)$$

wherein $T_c$ is the thickness of the high silicon alloy coating, in μm, and when the high silicon alloy coating is formed on both sides of the steel plate, the thickness of the high silicon alloy coating is the sum of coating thickness of two sides of the steel plate; $T_s$ is the thickness of the decarburization annealed steel plate to be sprayed, in μm; x1 is target silicon content of the high silicon grain-oriented electrical steel plate, in wt %; x2 is an initial silicon content of the steel plate to be sprayed, in wt %; x3 is the silicon content of the high silicon alloy particles, in wt %.

When the thickness of coating satisfies $T_c/T_s < (x1-x2)/(x3-x1)$, the total silicon content contained in the steel plate and alloy coating will be lower than the target silicon content of the high silicon grain-oriented electrical steel plate, which is impossible to obtain the desired high silicon steel plate through subsequent siliconizing treatment, and considering such factors as the inevitable voids in the coating and the stability of subsequent siliconizing, it is required that $T_c/T_s \geq (x1-x2)/(x3-x1)$. Under conditions where other process parameters are stable, the thickness of coating Tc is usually controlled accurately to make the actual silicon content in the steel plate approach to the target silicon content. Further, in the method for manufacturing a high silicon grain-oriented electrical steel plate according to the present invention, in the step (1), the total oxygen content on the surface of the decarburization annealed steel plate to be sprayed is controlled as less than 700 ppm, the element C content being controlled as less than 50 ppm, and the dew point of the decarburization annealing step is controlled as 40~65° C.

In the method of the present invention, the total oxygen content on the surface of the decarburization annealed steel plate to be sprayed is controlled as less than 700 ppm, and the element C content is less than 50 ppm. The inventor of the invention finds through research that when the dew point of the decarburization annealing step is controlled as 40~65° C., the decarburization effect can be ensured so as to eliminate the magnetic aging of the final product, and the formation of oxide film on the surface of the steel plate can be inhibited. On one hand, it is beneficial for the high silicon alloy particles to be combined with the decarburization annealed steel plate. On the other hand, it is also beneficial for the high silicon alloy coating to infiltrate toward the decarburization annealed steel plate to be sprayed with silicon during the annealing process of step (4). Since the high silicon alloy coating is formed, the surface of the steel plate has sufficient roughness, so that the coating ability of the insulating coating in the insulating coating process that may be contained after step (4) can be guaranteed, without forming magnesium silicate base layer as in the conventional process for manufacturing the grain-oriented electrical steel plate. Therefore the total oxygen content on the surface of the steel plate to be sprayed is less than that of the conventional process.

Further, the method for manufacturing a high silicon grain-oriented electrical steel plate according to the present invention, wherein in step (4), implementing a secondary recrystallization at an annealing temperature above 1100° C. and in a $N_2$+$H_2$ atmosphere, and then evenly heating the steel plate at temperature above 1150° C. for at least 20 hours and in a reducing atmosphere having a $H_2$ content over 90%, so as to achieve a uniform diffusion of element Si.

Further, the method for manufacturing a high silicon grain-oriented electrical steel plate according to the present invention, wherein in step (4), the method further comprises the steps of: applying an insulating coating and performing hot stretching leveling annealing.

In the method of the present invention, in some embodiments, before applying the insulating coating, an acid solution may be used to remove the unreacted components left on the surface of the steel plate after step (4), and then an insulating coating containing phosphate and colloidal silicon dioxide is coated and hot stretching leveling annealing is performed to finally obtain a high silicon grain-oriented electrical steel plate with excellent magnetic properties.

In addition, it should be noted that, in some embodiments, the cold spray treatment device for implementing step (2) of the method of the present invention includes: a gas tank, a gas control device, a particle conveyor, a gas heater, and a support roller with temperature control function, a nozzle device, a particle recovery device, a steel plate temperature detection device for measuring temperature of steel plate. The specific treating process of the cold spray device is described here. The working gas in the gas tank is transported to the gas heater through the gas control device; the working gas is heated by the gas heater and then transported to the nozzle device, and is accelerated in the nozzle device to form high speed jet. After the particle conveyor injects the high silicon alloy particles into the nozzle device, the high silicon alloy particles are accelerated to collision velocity by the high speed jet. When particles collide with the surface of the decarburization annealed steel plate to be sprayed at high speed, a high silicon alloy coating is formed on the surface of the steel plate to be sprayed. One or more nozzle devices can be arranged side-by-side around the support roller that are provided with temperature control function, so that the decarburization annealed steel plate to be sprayed is cold sprayed when running through the support roller, such that the treatment process of step (2) is achieved. In addition, the nozzle device can be fixed around the support roller or move back and forth along the width direction of the steel plate to be sprayed. The high silicon alloy particles left after colliding with the surface of the steel plate to be sprayed at high speed are collected by the particle recovery device.

Compared with the prior art, the method for manufacturing a high silicon grain-oriented electrical steel plate of the present invention has the following beneficial effects:

(1) The method for manufacturing a high silicon grain-oriented electrical steel plate of the present invention is based on conventional manufacturing lines and can mass-produce high silicon grain-oriented electrical steel plates by adding a set of cold spray treatment device, thereby solving the existing problem of high manufacturing cost.

(2) The method for manufacturing a high silicon grain-oriented electrical steel plate of the present invention enables high silicon alloy particles to be solid-deposited on the surface of the steel plate to be sprayed at a low temperature, which can significantly reduce or even completely eliminate adverse effects such as oxidation and phase transformation of high silicon alloy particles. Thereby, the stability of siliconizing during the annealing process of step (4) is ensured, and the problem of unstable quality of the high silicon steel plate in the existing manufacturing method is solved.

(3) The high silicon grain-oriented electrical steel plate manufactured by the method of the present invention has excellent magnetic properties, and the method has broad application prospects.

BRIEF DESCRIPTION OF DRAWINGS

FIG. 1 is a schematic view showing a structure of a cold spray treatment device for realizing the cold spray treatment process in the method for manufacturing the high silicon grain-oriented electrical steel plate of the present invention in some embodiments.

DETAILED DESCRIPTION OF INVENTION

The method for manufacturing the high silicon grain-oriented electrical steel plate of the present invention will be further explained and described in conjunction with the description of the drawings and specific embodiments. However, the explanation and the description do not improperly limit the technical solution of the present invention.

FIG. 1 is a schematic view showing a structure of a cold spray treatment device for realizing the cold spray treatment process in the method for manufacturing the high silicon grain-oriented electrical steel plate of the present invention in some embodiments. It can be seen that the cold spray treatment device for realizing the cold spray treatment process in the manufacturing method of the present invention includes: a gas tank 3, a gas control device 4, a particle conveyor 5, a gas heater 6, a support roller 7 with temperature control function, a nozzle device 8, a particle recovery device 9, and a steel plate temperature detection device 10 for measuring temperature of steel plate.

The specific working mode is described here. After a cold-rolled steel plate 1 undergoes decarburization annealing treatment in a decarburization annealing furnace 2, it enters the cold spray treatment device for treatment. The working gas in the gas tank 3 is transported to the gas heater 6 through the gas control device 4 (such as pipelines and valves); the working gas is heated by the gas heater 6 and then transported to the nozzle device 8, and is accelerated in the nozzle device 8 to form high speed jet. After the particle conveyor 5 injects the high silicon alloy particles into the nozzle device 8, the high silicon alloy particles are accelerated to collision velocity by the high speed jet. When particles collide with the surface of the decarburization annealed steel plate to be sprayed at high speed, a high silicon alloy coating is formed on the surface of the steel plate to be sprayed. The nozzle device 8 is fixedly arranged around the support roller 7 that is provided with temperature control function, so that the decarburization annealed steel plate to be sprayed is cold sprayed when running through the support roller 7. In addition, in some other embodiments, the nozzle device 8 can also move back and forth along the width direction of the steel plate to be sprayed. The high silicon alloy particles left after colliding with the surface of the steel plate to be sprayed at high speed are collected by the particle recovery device 9. After the steel plate is cold sprayed, it enters a separation agent coating system 11 for subsequent processing.

Below, this technical solution will use specific example data to further describe the technical solution of this case and prove the beneficial effects of this case:

The steel billets in Example 1-24 and Comparative Example 1-15 use the same mass percentage of chemical elements.

Table 1 lists the mass percentages of the chemical elements of the steel billets of the high silicon grain-oriented electrical steel plates in Example 1-24 and Comparative Example 1-15.

TABLE 1

(wt %, the balance is Fe and other unavoidable impurities)

| Si | C | Mn | S | Als | N |
|---|---|---|---|---|---|
| 3.15 | 0.046 | 0.11 | 0.005 | 0.030 | 0.0065 |

Examples 1-10 and Comparative Examples 1-5

The high silicon grain-oriented electrical steel plates of Examples 1-10 and Comparative Examples 1-5 were prepared by the following steps of:

(1) reheating the steel billet containing the mass percentage of each chemical element in Table 1 at 1050~1215° C., then hot rolling and annealing at 1050~1150° C. and pickling; thereafter rolling by a single stand mill;

(2) in an atmosphere of the mixture of humid nitrogen and hydrogen with a dew point of 40~65° C., performing a decarburization annealing with the cold-rolled steel plate at an annealing temperature of 820~850; controlling the total oxygen content on the surface of the decarburization annealed steel plate to be sprayed to be less than 700 ppm, and controlling element C content to be less than 50 ppm;

(3) ejecting the high silicon alloy particles and the heated working gas (nitrogen) of 400° C. onto the surface of the steel plate to be sprayed via a Laval nozzle with a conical inner surface so that making the high silicon alloy particles of complete solid state collide with the surface of the decarburization annealed steel plate to be sprayed at a speed of 500-900 m/s, thereinto, the high silicon alloy particles having a Si content of 10-50 wt %, the high silicon alloy particles having a particle size of 1-80 nm, the temperature of the high silicon alloy particles at the outlet of the nozzle being controlled as 300° C., and the outlet of the nozzle being set 25 mm away from the surface of the steel plate to be sprayed;

(4) coating a separation agent MgO and kiln drying;

(5) annealing: implementing a secondary recrystallization at an annealing temperature above 1100° C. in a $N_2$+$H_2$ atmosphere, and then evenly heating the steel plate at a temperature above 1150° C. for at least 20 hours in a reducing atmosphere having a $H_2$ content over 90%;

(6) removing unreacted components left on the surface of the annealed steel plate via acid, then applying an insulating coating containing phosphate and colloidal silicon dioxide and performing hot stretching leveling annealing, so as to obtain the finished steel plate.

Table 2-1, Table 2-2, and Table 2-3 list the specific process parameters of the method for manufacturing the high silicon grain-oriented electrical steel plates of Examples 1-10 and Comparative Examples 1-5.

TABLE 2-1

| | Step(1) | | Step (2) | | | |
|---|---|---|---|---|---|---|
| Serial number | Reheating temperature of billet(° C.) | Annealing temperature of hot rolled plate (° C.) | Dew point temperature of decarburization annealing (° C.) | Decarburization annealing temperature (° C.) | Total oxygen content on the surface of steel plate to be sprayed (ppm) | Element C content on the surface of steel plate to be sprayed (ppm) |
| Example 1 | 1083 | 1086 | 45 | 840 | 503 | 15 |
| Example 2 | 1190 | 1141 | 60 | 830 | 498 | 20 |
| Example 3 | 1125 | 1078 | 54 | 830 | 398 | 39 |
| Example 4 | 1198 | 1144 | 60 | 840 | 592 | 11 |
| Example 5 | 1116 | 1097 | 52 | 820 | 481 | 25 |
| Example 6 | 1095 | 1149 | 64 | 845 | 420 | 28 |
| Example 7 | 1118 | 1055 | 45 | 840 | 357 | 41 |
| Example 8 | 1080 | 1087 | 55 | 840 | 596 | 22 |
| Example 9 | 1061 | 1140 | 65 | 835 | 440 | 13 |
| Example 10 | 1146 | 1100 | 52 | 835 | 624 | 18 |
| Comparative Example 1 | 1132 | 1094 | ***35*** | ***815*** | 339 | ***53*** |
| Comparative Example 2 | 1193 | ***1000*** | 41 | ***855*** | 666 | 29 |
| Comparative Example 3 | 1215 | 1126 | 54 | 830 | 541 | 20 |
| Comparative Example 4 | ***1250*** | 1056 | 62 | 825 | 634 | 41 |
| Comparative Example 5 | 1201 | ***1180*** | ***70*** | 830 | ***820*** | 12 |

TABLE 2-2

| Serial number | Step(3) Si content in high silicon alloy particles (wt %) | Particle size of high silicon alloy particles (μm) | Collision velocity of high silicon alloy particles (m/s) | Thickness of high silicon alloy coating Tc (μm) | Thickness of steel plate to be sprayed Ts (μm) | Target silicon content (wt %) | Spray surface | Tc/Ts | (x1 − x2)/(x3 − x1) |
|---|---|---|---|---|---|---|---|---|---|
| Example 1 | 11.3 | 72 | 757 | 142 | 220 | 5.0 | both sides | 0.645 | 0.294 |
| Example 2 | 18.6 | 46 | 849 | 65 | 285 | 5.0 | both sides | 0.228 | 0.136 |
| Example 3 | 26.5 | 13 | 684 | 52 | 260 | 6.5 | upper surface | 0.200 | 0.168 |
| Example 4 | 26.5 | 38 | 684 | 48.3 | 260 | 6.5 | upper surface | 0.186 | 0.168 |
| Example 5 | 37.9 | 25 | 686 | 40.1 | 260 | 6.5 | upper surface | 0.154 | 0.107 |
| Example 6 | 37.9 | 25 | 628 | 25.9 | 220 | 6.5 | upper surface | 0.118 | 0.107 |
| Example 7 | 37.9 | 25 | 618 | 29.2 | 220 | 6.5 | upper surface | 0.133 | 0.107 |
| Example 8 | 45.6 | 25 | 615 | 28.0 | 220 | 6.5 | lower surface | 0.127 | 0.086 |
| Example 9 | 45.6 | 18 | 531 | 22.7 | 220 | 6.5 | upper surface | 0.103 | 0.086 |
| Example 10 | 49.5 | 1.5 | 609 | 21.3 | 220 | 6.5 | upper surface | 0.097 | 0.078 |
| Comparative Example 1 | ***55.8*** | 25 | 685 | ***unbonding*** | 260 | 6.5 | both sides | ***unbonding*** | 0.068 |
| Comparative Example 2 | ***9.5*** | 25 | 781 | 200 | 260 | 6.5 | both sides | 0.769 | 1.117 |
| Comparative Example 3 | 36.5 | ***81*** | ***484*** | ***unbonding*** | 260 | 6.5 | both sides | ***unbonding*** | 0.112 |
| Comparative Example 4 | 38.9 | ***0.8*** | 673 | ***unbonding*** | 260 | 6.5 | both sides | ***unbonding*** | 0.103 |
| Comparative Example 5 | 37.9 | 10 | 785 | 15.8 | 260 | 6.5 | upper surface | ***0.061*** | 0.107 |

Among them, x1 is a target silicon content of the high silicon grain-oriented electrical steel plate, and its unit parameter is wt %; x2 is an initial silicon content of the steel plate to be sprayed, and its unit parameter is wt %; x3 is a silicon content of the high silicon alloy particles, and its unit parameter is wt %.

TABLE 2-3

| Serial number | Step(5) Annealing temperature of secondary recrystallization (° C.) | $H_2$ content (%) | High temperature of uniform heating (° C.) | Uniform heating time (h) |
|---|---|---|---|---|
| Example 1 | 1100 | 95 | 1175 | 36 |
| Example 2 | 1100 | 95 | 1175 | 36 |
| Example 3 | 1100 | 95 | 1200 | 28 |
| Example 4 | 1120 | 95 | 1200 | 28 |
| Example 5 | 1120 | 100 | 1200 | 28 |
| Example 6 | 1120 | 100 | 1200 | 28 |
| Example 7 | 1120 | 100 | 1220 | 24 |
| Example 8 | 1150 | 100 | 1220 | 24 |
| Example 9 | 1150 | 100 | 1220 | 24 |
| Example 10 | 1150 | 100 | 1220 | 24 |
| Comparative Example 1 | 1120 | 100 | 1200 | 28 |
| Comparative Example 2 | 1120 | ***85*** | ***1130*** | 28 |
| Comparative Example 3 | 1120 | 100 | 1200 | 28 |
| Comparative Example 4 | 1120 | 100 | 1200 | 28 |
| Comparative Example 5 | 1120 | 100 | 1200 | ***18*** |

The performances of the high silicon grain-oriented electrical steel plates of Examples 1-10 and Comparative Examples 1-5 were tested for iron loss $P_{10/400}$, magnetic induction $B_8$ and magnetostriction $\lambda_{10/400}$. The test results are listed in Table 3.

TABLE 3

| Serial number | $P_{10/400}$ (W/Kg) | $B_8$ (T) | Magnetostriction $\lambda_{10/400}$ ($\times 10^{-6}$) | Si content in finished steel plate (wt %) |
|---|---|---|---|---|
| Example 1 | 7.5 | 1.65 | 0.4 | 4.5 |
| Example 2 | 7.0 | 1.57 | 0.3 | 5.6 |
| Example 3 | 6.7 | 1.65 | 0.2 | 6.3 |
| Example 4 | 6.6 | 1.47 | 0.1 | 6.7 |
| Example 5 | 6.4 | 1.47 | 0.1 | 6.8 |
| Example 6 | 7.3 | 1.67 | 0.3 | 6.0 |
| Example 7 | 6.3 | 1.37 | 0.1 | 6.4 |
| Example 8 | 7.0 | 1.40 | 0.1 | 6.7 |
| Example 9 | 5.7 | 1.49 | 0.1 | 6.5 |
| Example 10 | 5.9 | 1.37 | 0.1 | 6.9 |
| Comparative Example 1 | — | — | — | — |
| Comparative Example 2 | 8.7 | 1.91 | 0.7 | 3.5 |
| Comparative Example 3 | — | — | — | — |
| Comparative Example 4 | — | — | — | — |
| Comparative Example 5 | 8.9 | 1.91 | 0.6 | 3.7 |

It can be seen from Table 3 that all Examples 1-10 can obtain high silicon grain-oriented electrical steel plates with a silicon content higher than 4 wt %. The test results show that, compared with the finished steel plates with conventional silicon content, high-silicon steel plates have relatively low $B_8$ due to the increase in silicon content, while high-silicon steel plates have excellent high-frequency magnetic properties with high-frequency iron loss $P_{10/400}$ between 5.7~7.5 W/kg and magnetostriction $\lambda_{10/400}$ less than $0.4\times10^{-6}$. Comparative Examples 1-5 cannot obtain the required high silicon grain-oriented electrical steel plates.

In order to verify the quality and performance of the sprayed steel plate, this technical solution includes Examples 11-20 and Comparative Examples 6-12. In Examples 11-20 and Comparative Examples 6-12, the high silicon grain-oriented electrical steel plate were sprayed by the following steps of:

(1) reheating the steel billet containing the mass percentage of each chemical element of Table 1 at 1050~1215° C., then hot rolling and annealing at 1050~1150° C. and pickling; thereafter cold rolling by a single stand mill to obtain a cold-rolled steel plate with a size of 0.285 mm;

(2) in an atmosphere of the mixture of humid nitrogen and hydrogen with a dew point of 40~65° C., performing a decarburization annealing with the cold-rolled steel plate at an annealing temperature of 820~850; controlling the total oxygen content on the surface of the decarburization annealed steel plate to be sprayed to be less than 700 ppm, and controlling element C content to be less than 50 ppm, so as to obtain a decarburization annealed steel plate with a size of 0.285 mm;

(3) ejecting the high silicon alloy particles and the heated working gas (such as nitrogen) onto the surface of the steel plate to be sprayed via a Laval nozzle with a conical inner surface so that making the high silicon alloy particles of complete solid state collide with the surface of the decarburization annealed steel plate to be sprayed at a speed of 500-900 m/s, thereinto, the high silicon alloy particles having a Si content of 37.9 wt %, the high silicon alloy particles having a particle size of 20 μm, the temperature of the high silicon alloy particles at the outlet of the nozzle being controlled as 80-500° C., and the outlet of the nozzle being set 10-60 mm away from the surface of the steel plate to be sprayed; the Si content in the final high silicon grain-oriented electrical steel plate being expected to be 6.5 wt %.

Table 4-1 and Table 4-2 list the specific process parameters of the spraying and pre-spraying steps of Examples 11-20 and Comparative Examples 6-12.

TABLE 4-1

| | Step(1) | | Step (2) | | | |
|---|---|---|---|---|---|---|
| Serial number | Reheating temperature of billet(° C.) | Annealing temperature of hot rolled plate (° C.) | Dew point temperature of decarburization annealing(° C.) | Decarburization annealing temperature (° C.) | Total oxygen content on the surface of steel plate to be sprayed (ppm) | Element C content on the surface of steel plate to be sprayed (ppm) |
| Example 11 | 1208 | 1114 | 47 | 838 | 396 | 23 |
| Example 12 | 1185 | 1144 | 59 | 823 | 514 | 9 |
| Example 13 | 1068 | 1059 | 59 | 828 | 625 | 29 |
| Example 14 | 1099 | 1083 | 58 | 848 | 558 | 21 |
| Example 15 | 1125 | 1120 | 56 | 838 | 530 | 27 |
| Example 16 | 1200 | 1059 | 51 | 833 | 634 | 15 |
| Example 17 | 1076 | 1137 | 57 | 833 | 347 | 20 |
| Example 18 | 1087 | 1101 | 48 | 833 | 529 | 7 |
| Example 19 | 1161 | 1129 | 53 | 823 | 425 | 48 |
| Example 20 | 1085 | 1132 | 56 | 838 | 586 | 23 |
| Comparative Example 6 | 1134 | 1138 | 50 | 838 | 662 | 17 |
| Comparative Example 7 | 1060 | 1101 | 53 | 843 | 668 | 16 |
| Comparative Example 8 | 1103 | 1085 | 46 | 828 | 366 | 24 |
| Comparative Example 9 | 1091 | 1052 | 58 | 828 | 394 | 24 |
| Comparative Example 10 | 1199 | 1065 | 59 | 833 | 623 | 14 |
| Comparative Example 11 | 1196 | 1073 | 62 | 843 | 623 | 10 |
| Comparative Example 12 | 1084 | 1076 | 45 | 838 | 372 | 24 |

TABLE 4-2

| | | Step(3) | | | | | | | |
|---|---|---|---|---|---|---|---|---|---|
| Serial number | Working gas | Collision velocity of high silicon alloy particles (m/s) | Temperature of high silicon alloy particles at the outlet of the nozzle (° C.) | Temperature of working gas(° C.) | Distance between the outlet of the nozzle and the surface of the steel plate to be sprayed (mm) | Spray surface | Thickness of high silicon alloy coating Tc(μm) | Tc/Ts | (x1 − x2)/(x3 − x1) |
| Example 11 | $N_2$ | 500 | 500 | 200 | 25 | upper surface | 31.5 | 0.111 | 0.107 |
| Example 12 | $N_2$ | 500 | 250 | 450 | 25 | both sides | 38.4 | 0.135 | 0.107 |
| Example 13 | $N_2$ | 650 | 80 | 450 | 60 | upper surface | 37.5 | 0.132 | 0.107 |
| Example 14 | $N_2$ | 650 | 125 | 300 | 45 | upper surface | 41.6 | 0.146 | 0.107 |
| Example 15 | $N_2$ | 650 | 250 | 300 | 30 | upper surface | 50.3 | 0.176 | 0.107 |
| Example 16 | $N_2$ + He | 650 | 250 | 450 | 25 | upper surface | 49.6 | 0.174 | 0.107 |
| Example 17 | $N_2$ | 650 | 450 | 500 | 10 | upper surface | 52.8 | 0.185 | 0.107 |
| Example 18 | He | 750 | 300 | 450 | 25 | lower surface | 70.8 | 0.248 | 0.107 |
| Example 19 | He | 750 | 300 | 550 | 25 | upper surface | 73.8 | 0.259 | 0.107 |
| Example 20 | He | 900 | 300 | 700 | 25 | both sides | 130.8 | 0.459 | 0.107 |
| Comparative Example 6 | $N_2$ | ***486*** | 300 | 300 | 25 | both sides | unbonding | — | 0.107 |

TABLE 4-2-continued

| Serial number | Working gas | Step(3) Collision velocity of high silicon alloy particles (m/s) | Temperature of high silicon alloy particles at the outlet of the nozzle (° C.) | Temperature of working gas(° C.) | Distance between the outlet of the nozzle and the surface of the steel plate to be sprayed (mm) | Spray surface | Thickness of high silicon alloy coating Tc(μm) | Tc/Ts | (x1 − x2)/(x3 − x1) |
|---|---|---|---|---|---|---|---|---|---|
| Comparative Example 7 | $N_2$ | ***915*** | 300 | 300 | 25 | both sides | a little bonding | — | 0.107 |
| Comparative Example 8 | $N_2$ | 630 | ***62*** | ***180*** | 25 | both sides | unbonding | — | 0.107 |
| Comparative Example 9 | $N_2$ | 630 | 300 | ***720*** | 25 | both sides | 135.3 | 0.475 | 0.107 |
| Comparative Example 10 | $N_2$ | 630 | ***510*** | ***720*** | 25 | both sides | 158.9 | 0.558 | 0.107 |
| Comparative Example 11 | $N_2$ | 630 | 300 | 550 | ***8*** | both sides | 125.6 | 0.441 | 0.107 |
| Comparative Example 12 | $N_2$ | 630 | 300 | 550 | ***62*** | upper surface | 25.8 | 0.091 | 0.107 |

Among them, x1 is a target silicon content of the high silicon grain-oriented electrical steel plate, and its unit parameter is wt %; x2 is an initial silicon content of the steel plate to be sprayed, and its unit parameter is wt %; x3 is a silicon content of the high silicon alloy particles, and its unit parameter is wt %.

The mass of the high silicon alloy coating of the high silicon grain-oriented electrical steel plates of Examples 11-20 and Comparative Examples 6-12 are listed in Table 5.

TABLE 5

| Serial number | Mass of high silicon alloy coating |
|---|---|
| Example 11 | The coating thickness met the minimum requirements and was not oxidized |
| Example 12 | The coating thickness met the minimum requirements and was not oxidized |
| Example 13 | The coating thickness met the minimum requirements and was not oxidized |
| Example 14 | The coating thickness met the minimum requirements and was not oxidized |
| Example 15 | The coating thickness met the minimum requirements and was not oxidized |
| Example 16 | The coating thickness met the minimum requirements and was not oxidized |
| Example 17 | The coating thickness met the minimum requirements and was not oxidized |
| Example 18 | The coating thickness met the minimum requirements and was not oxidized |
| Example 19 | The coating thickness met the minimum requirements and was not oxidized |
| Example 20 | The coating thickness met the minimum requirements and was not oxidized |
| Comparative Example 6 | unbonding |
| Comparative Example 7 | a little bonding, coating oxidation |
| Comparative Example 8 | unbonding |
| Comparative Example 9 | coating oxidation |
| Comparative Example 10 | coating oxidation |
| Comparative Example 11 | coating oxidation |
| Comparative Example 12 | coating was thin |

It can be seen from Table 5 that all Examples 11-20 can obtain required high silicon alloy coatings, while Comparative Examples 6-12 cannot obtain required high silicon alloy coatings.

The high silicon grain-oriented electrical steel plates of Example 21-24 and Comparative Example 13-15 were prepared by the following steps of:

(1) reheating the steel billet containing the mass percentage of each chemical element of Table 1 at 1050~1215° C., then hot rolling and annealing at 1050~1150° C. and pickling; thereafter cold rolling by a single stand mill to obtain a steel plate with the target thickness;

(2) in an atmosphere of the mixture of humid nitrogen and hydrogen with a dew point of 40~65° C., performing a decarburization annealing with the cold-rolled steel plate at an annealing temperature of 820~850; controlling the total oxygen content on the surface of the decarburization annealed steel plate to be sprayed to be less than 700 ppm, and controlling element C content to be less than 50 ppm;

(3) ejecting the high silicon alloy particles and the heated working gas (such as nitrogen) onto the surface of the steel plate to be sprayed via a Laval nozzle with a conical inner surface so that making the high silicon alloy particles of complete solid state collide with the surface of the decarburization annealed steel plate to be sprayed at a speed of 650 m/s, thereinto, the high silicon alloy particles having a Si content of 37.9 wt %, the high silicon alloy particles having a particle size of 20 μm, the temperature of the high silicon alloy particles at the outlet of the nozzle being controlled as 250° C., and the outlet of the nozzle being set 25 mm away from the surface of the steel plate to be sprayed;

(4) coating a separation agent MgO and kiln drying;

(5) annealing: implementing a secondary recrystallization at an annealing temperature above 1100° C. in a $N_2$+$H_2$ atmosphere, and then evenly heating the steel plate at a temperature above 1150° C. for at least 20 hours in a reducing atmosphere having a $H_2$ content over 90%;

(6) removing unreacted components left on the surface of the annealed steel plate via acid, then applying an insulating coating containing phosphate and colloidal silicon dioxide and performing hot stretching leveling annealing, so as to obtain the finished steel plate.

Table 6-1, Table 6-2, and Table 6-3 list the specific process parameters of the method for manufacturing the high silicon grain-oriented electrical steel plates of Examples 21-24 and Comparative Examples 13-15.

TABLE 6-1

| Serial number | Step (1) Reheating temperature of billet(° C.) | Step (1) Annealing temperature of hot rolled plate (° C.) | Step (2) Dew point temperature of decarburization annealing (° C.) | Step (2) Decarburization annealing temperature (° C.) | Step (2) Total oxygen content on the surface of steel plate to be sprayed (ppm) | Step (2) Element C content on the surface of steel plate to be sprayed (ppm) |
|---|---|---|---|---|---|---|
| Example 21 | 1125 | 1060 | 45 | 825 | 325 | 25 |
| Example 22 | 1090 | 1060 | 55 | 825 | 423 | 27 |
| Example 23 | 1190 | 1070 | 60 | 830 | 567 | 11 |
| Example 24 | 1100 | 1115 | 65 | 835 | 665 | 36 |
| Comparative Example 13 | 1150 | 1100 | ***68*** | 840 | ***750*** | 19 |
| Comparative Example 14 | 1130 | 1150 | 65 | 830 | ***850*** | 20 |
| Comparative Example 15 | 1180 | 1080 | 35 | 830 | 403 | ***72*** |

TABLE 6-2

| Serial number | Step(3) Working gas | Step(3) Temperature of working gas(° C.) | Step(3) Thickness of steel plate to be sprayed Ts(μm) | Step(3) Target silicon content (wt %) | Step(3) Spray surface | Step(3) Thickness of high silicon alloy coating Tc(μm) | Step(3) Tc/Ts | Step(3) (x1 − x2)/(x3 − x1) |
|---|---|---|---|---|---|---|---|---|
| Example 21 | $N_2$ | 480 | 220 | 6.5 | upper surface | 47 | 0.213 | 0.107 |
| Example 22 | $N_2$ | 650 | 220 | 6.5 | upper surface | 28 | 0.130 | 0.107 |
| Example 23 | He | 340 | 260 | 6.5 | both sides | 78 | 0.298 | 0.107 |
| Example 24 | He | 380 | 260 | 6.5 | both sides | 75 | 0.289 | 0.107 |
| Comparative Example 13 | $N_2$ | 340 | 220 | 6.5 | upper surface | 45 | 0.204 | 0.107 |
| Comparative Example 14 | $N_2$ | 380 | 220 | 6.5 | upper surface | 53 | 0.242 | 0.107 |
| Comparative Example 15 | He | 340 | 260 | 6.5 | both sides | 61 | 0.236 | 0.107 |

Among them, x1 is a target silicon content of the high silicon grain-oriented electrical steel plate, and its unit parameter is wt %; x2 is an initial silicon content of the steel plate to be sprayed, and its unit parameter is wt %; x3 is a silicon content of the high silicon alloy particles, and its unit parameter is wt %.

TABLE 6-3

| Serial number | Step(5) Annealing temperature of secondary recrystal-lization (° C.) | Step(5) $H_2$ content (%) | Step(5) High temperature of uniform heating (° C.) | Step(5) Uniform heating time (h) |
|---|---|---|---|---|
| Example 21 | 1120 | 92 | 1175 | 32 |
| Example 22 | 1140 | 92 | 1175 | 32 |
| Example 23 | 1120 | 100 | 1200 | 28 |
| Example 24 | 1140 | 100 | 1200 | 28 |
| Comparative Example 13 | 1120 | 92 | 1175 | 32 |
| Comparative Example 14 | 1140 | 92 | 1175 | 32 |
| Comparative Example 15 | 1120 | 100 | 1200 | 28 |

The content of element Si in the finished steel plates of the high silicon grain-oriented electrical steel plates of Examples 21-24 and Comparative Examples 13-15 are listed in Table 7.

TABLE 7

| Serial number | Content of element Si in finished steel plate (wt %) |
|---|---|
| Example 21 | 6.7 |
| Example 22 | 6.1 |
| Example 23 | 6.5 |
| Example 24 | 6.7 |
| Comparative Example 13 | 3.9 |
| Comparative Example 14 | 3.7 |
| Comparative Example 15 | 6.7 |

It can be seen from Table 7 that all Examples 21-24 can obtain high silicon grain-oriented electrical steel plates with required Si content, while the silicon content in the finished steel plates of comparative examples 13 and 14 are less than 4 wt %. The C content on the surface of the decarburization annealed steel plate to be sprayed of Comparative Example 15 is higher than 50 ppm, and Comparative Examples 13-15 cannot obtain required high silicon grain-oriented electrical steel plates.

It should be noted that the prior art part of the protection scope of the present invention is not limited to the embodiments given in this application document, and all prior arts that do not contradict the solution of the present invention, including but not limiting the previous patent documents, prior publications, prior public use, etc., can all be included in the protection scope of the present invention.

In addition, the combination of various technical features in this case is not limited to the combination described in the claims of this case or the combination described in the specific embodiments. All technical features described in this case can be freely combined or integrated in any way, unless conflicts arise among them.

It should also be noted that the embodiments listed above are only specific embodiments of the present invention. Obviously, the present invention is not limited to the above embodiments, and the subsequent similar changes or modifications that can be directly derived from or easily associated with the disclosure of the present invention by those skilled in the art, should fall within the protection scope of the present invention.

The invention claimed is:

1. A method for manufacturing a high silicon grain-oriented electrical steel plate, wherein the high silicon grain-oriented electrical steel plate has a silicon content of greater than 4 wt %, the method comprising steps of:

(1) performing a decarburization annealing to a cold-rolled steel plate, thereby forming a decarburization annealed steel plate;

(2) spraying high silicon alloy particles of complete solid state collide on a surface of the decarburization annealed steel plate at a high speed of 500-900 m/s, so as to form a high silicon alloy coating on the surface of the decarburization annealed steel plate;

(3) further coating a separation agent on the high silicon alloy coating from step (2) and drying; and (4) annealing.

2. The method for manufacturing a high silicon grain-oriented electrical steel plate according to claim 1, wherein in step (2), the high silicon alloy particles have a Si content of 10-50 wt %.

3. The method for manufacturing a high silicon grain-oriented electrical steel plate according to claim 1, wherein in step (2), the high silicon alloy particles have a particle size of 1-80 μm.

4. The method for manufacturing a high silicon grain-oriented electrical steel plate according to claim 1, wherein in step (2), the high silicon alloy particles are driven by jet flow of working gas to collide.

5. The method for manufacturing a high silicon grain-oriented electrical steel plate according to claim 4, wherein the working gas is nitrogen, helium or mixture of nitrogen and helium.

6. The method for manufacturing a high silicon grain-oriented electrical steel plate according to claim 4, wherein the high silicon alloy particles and the working gas are ejected via a nozzle.

7. The method for manufacturing a high silicon grain-oriented electrical steel plate according to claim 6, wherein a temperature of the high silicon alloy particles at an outlet of the nozzle is controlled between 80-500° C.

8. The method for manufacturing a high silicon grain-oriented electrical steel plate according to claim 6, wherein the working gas is heated to 200-700° C. and then is sent to the nozzle.

9. The method for manufacturing a high silicon grain-oriented electrical steel plate according to claim 6, wherein the nozzle is a Laval nozzle.

10. The method for manufacturing a high silicon grain-oriented electrical steel plate according to claim 6, wherein the outlet of the nozzle is set 10-60 mm away from the surface of the decarburization annealed steel plate.

11. The method for manufacturing a high silicon grain-oriented electrical steel plate according to claim 1, wherein the high silicon alloy coating is formed on one side or both sides of the surface of the decarburization annealed steel plate, and a thickness of the high silicon alloy coating satisfies the following formula:

$$T_c/T_s \geq (x1-x2)/(x3-x1)$$

wherein $T_c$ is a thickness of the high silicon alloy coating, in μm, when the high silicon alloy coating is formed on both sides of the decarburization annealed steel plate, the thickness of the high silicon alloy coating is the sum of coating thickness of two sides of the decarburization annealed steel plate; $T_s$ is a thickness of the decarburization annealed steel plate, in μm; x1 is a target silicon content of the high silicon grain-oriented electrical steel plate, in wt %; x2 is an initial silicon content of the decarburization annealed steel plate, in wt %; x3 is a silicon content of the high silicon alloy particles, in wt %.

12. The method for manufacturing a high silicon grain-oriented electrical steel plate according to claim 1, wherein a total oxygen content on the surface of the decarburization annealed steel plate is controlled to less than 700 ppm, an element C content is controlled to less than 50 ppm, and a dew point of the decarburization annealing is controlled between 40-65° C.

13. The method for manufacturing a high silicon grain-oriented electrical steel plate according to claim 1, wherein in step (4), implementing a secondary recrystallization at an annealing temperature above 1100° C. and in a $N_2$+$H_2$ atmosphere, and then heating the coated decarburization annealed steel plate at temperature above 1150° C. for at least 20 hours and in a reducing atmosphere having a $H_2$ content over 90%, so as to achieve a uniform diffusion of element Si.

14. The method for manufacturing a high silicon grain-oriented electrical steel plate according to claim 1, wherein after the step (4), the method further comprises the steps of: applying an insulating coating and performing hot stretching leveling annealing.

* * * * *